United States Patent [19]

Mott

[11] Patent Number: 4,597,350

[45] Date of Patent: Jul. 1, 1986

[54] MOORING SYSTEM AND LIQUID CARGO TRANSFER FACILITY FOR ICE INFESTED WATERS

[75] Inventor: George E. Mott, Metairie, La.

[73] Assignee: Texaco Inc., White Plains, N.Y.

[21] Appl. No.: 691,820

[22] Filed: Jan. 16, 1985

[51] Int. Cl.[4] ..... B63B 35/10

[52] U.S. Cl. ..... 114/230; 114/40; 114/41; 405/224

[58] Field of Search ..... 441/3–5; 405/203, 217, 224, 226, 202; 175/7; 114/230, 293, 264, 40, 41

[56] References Cited

U.S. PATENT DOCUMENTS

| | | | |
|---|---|---|---|
| 3,360,810 | 1/1968 | Busking | 441/5 |
| 3,524,323 | 8/1970 | Miller | 405/202 |
| 3,708,985 | 1/1973 | Pogonowski et al. | 405/202 |
| 4,141,668 | 2/1979 | Engel | 405/202 |

FOREIGN PATENT DOCUMENTS

| | | | |
|---|---|---|---|
| 1418802 | 10/1965 | France | 405/224 |
| 86230 | 11/1965 | France | 405/224 |
| 88968 | 3/1967 | France | 405/224 |
| 57-4493 | 1/1982 | Japan | 114/230 |

*Primary Examiner*—Trygve M. Blix
*Assistant Examiner*—Edwin L. Swinehart
*Attorney, Agent, or Firm*—Robert A. Kulason; James J. O'Loughlin; Robert B. Burns

[57] ABSTRACT

A mooring and liquid transfer column which is fixed to the floor of an offshore body of water for securing a marine vessel. The column is resiliently retained and cable supported to permit its being deflected in response to ice forces acting thereagainst. The column upper end includes a narrow tower which extends beyond the water's surface and encloses fluid carrying conduits. A plurality of support cables depend from the column to transmit ice resisting forces into one or more remote anchors to which the support cables are attached.

4 Claims, 4 Drawing Figures

MOORING SYSTEM AND LIQUID CARGO TRANSFER FACILITY FOR ICE INFESTED WATERS

BACKGROUND OF THE INVENTION

Many facilities for the storage of liquid and gaseous products such as crude and refined petroleum products, are located in terminals at the water's edge. To transfer these liquids either by a loading or offloading operation to a vessel, the terminals are normally provided with the usual docking means. The vessel or tanker can thereby be fixed in place and connected to the desired flow lines.

The vessels for transporting liquid and gaseous petroleum products are relatively large and consequently require water depths often exceeding 100 feet in which they must be maneuvered. Since many of the present terminals are at locations which do not enjoy the advantage of being accessible to deep water, these larger vessels cannot be readily used.

One method for overcoming this problem is through the use of offshore moorings which can be positioned in a water depth at which the larger vessels can be operated. Thus, the mooring is positioned sufficiently far from the loading facility to permit it to receive and hold the large vessels in place during a cargo transfer operation. This latter operation embodies the use of a plurality of conduits which extend along the ocean floor between the mooring and the onshore storage facility.

Offshore vessel mooring systems have been successfully used in many instances. However, where the terminal is located in waters which are customarily plagued by floating ice, the mooring problem is accentuated. For example, sheet ice in any body of water has the capability of building into larger floes which, over a period of time, can impair liquid transfer operations in the area. Further, the presence of sheet ice which moves through an area can exert a considerable force against anything, including a loading mooring, positioned in its path.

It can be appreciated that the presence of an offshore mooring of the type above described, if positioned in an ice infested body of water, will operate only with difficulty. Specifically it will be subjected to extreme wear and displacing forces due to the presence of moving ice along the surface of the water.

A further disadvantage experienced with the offshore loading means of the type contemplated is that the displacing forces exerted by a moored vessel can be greatly accentuated in severe weather conditions. Thus, both wind and waves acting against a vessel greatly accentuate the forces which in turn exert a displacing pull on a mooring column.

Mooring columns, staples, or masts are generally fixed in place through a pivotal joint at their lower end. The column therefore has the capability of being deflected from a normally vertical position. The lower end of the column, however, normally includes a fixed base or foundation which is piled into the ocean floor with sufficient piles to exert a desired restraining force.

In this type of mooring arrangement, however, a heavy pull or tension exerted along the water's surface by a vessel, will in turn exert a considerable force against the pivotal connection between the column and base. This connector is a vital part of the overall system. To be effective therefore it must be either strengthened, or protected to avoid being damaged by forces exerted by either ice, or a moored vessel.

Toward overcoming the above noted problems associated with offshore mooring of vessels, there is presently provided a mooring system including a mast, which is operably fixed to the ocean floor. In the normal manner, the upright mast is comprised of an elongated body connected at its lower end through a pivotal joint to a fixedly positioned foundation.

The structure and bracing of the upright mast are such that it can be deflected from a vertical position in response to the normal displacing forces which add to the pull of a moored vessel.

The upper end of the mast is provided with a relatively thin column which presents a minimal surface against which moving ice can act. Thus, the column extends from a point below the water's surface to a distance thereabove. Means is provided in the column for engaging the mooring lines of a vessel to which it is detachably engaged. It also includes fluid conducting conduits or hoses which will be communicated with the vessel's cargo tanks for an on or offloading operation.

The mooring mast is provided with a pluraliy of anchored support cables positioned thereabout. Thus, the forces normally exerted by a moored vessel will cause the mast to deflect and it will be transmitted into the support cables and remote anchors rather than into the structure of the column and its pivotal connector.

In one embodiment, the respective cables are terminated at the mooring foundation by way of a plurality of pile anchors which are embedded into the ocean floor a desired distance away from the foot of the column. Said anchors are preferably spaced radially from each other to best absorb forces exerted by the vessel and by moving ice.

It is therefore an object of the invention to provide a mooring mast or facility for a marine vessel which is capable of operating in ice infested waters to permit either an on or offloading of a fluid cargo between the vessel and a shore facility.

A further object is to provide a mooring means of the type contemplated which can be subjected to induced oscillations for the purpose of breaking up sheet ice formations which tend to solidify at the water's surface.

A still further object is to provide a cable supported mooring mast of the type contemplated which will engage a floating vessel in a manner to permit transfer of the vessel's lateral pull to a plurality of anchoring cables, rather than to the mast.

DESCRIPTION OF THE DRAWINGS

FIG. 1 illustrates in general an offshore mooring facility of the type presently contemplated which includes essentially a mooring mast 10 uprightly supported in an offshore body of water. Mast 10 comprises primarily an elongated body 11 which approximates in length the water depth, and is provided at the lower end with a universal pivotal connector 12. The latter in turn depends from a foundation 13 or base which is piled into the ocean floor by a plurality of downwardly extending piles 14.

Figure 1:
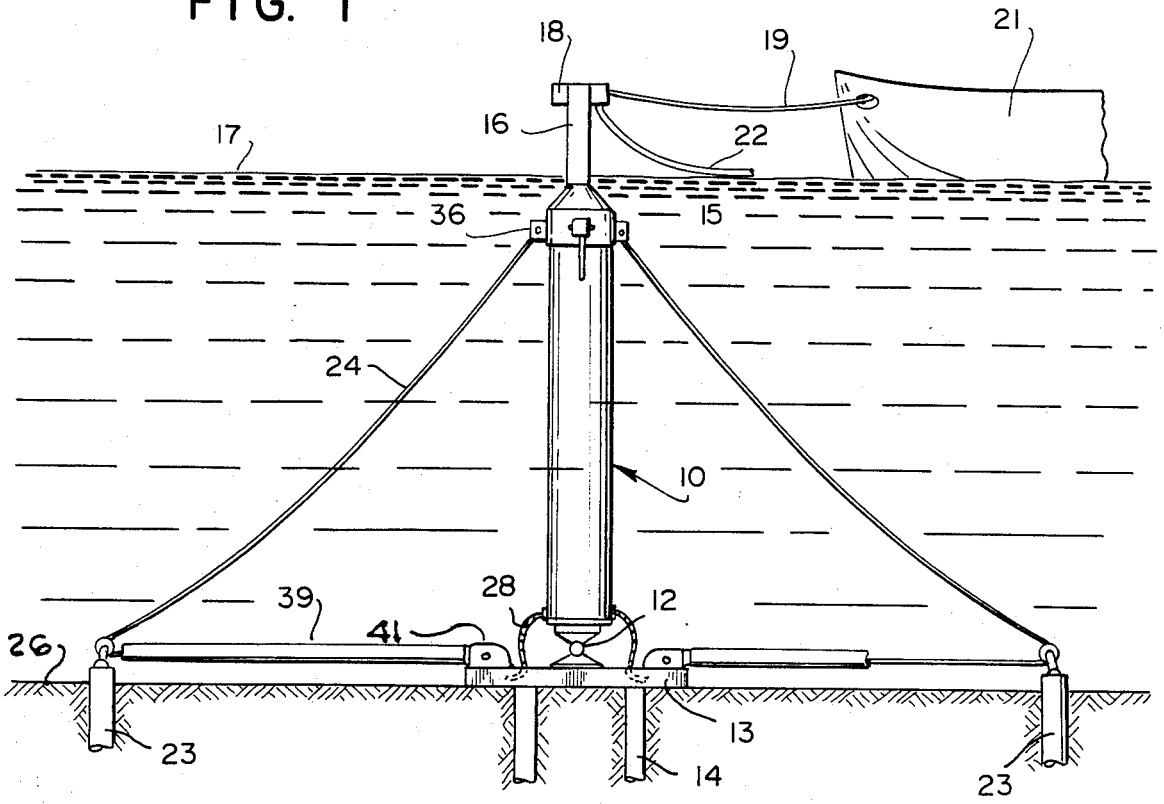
FIG. 1 is a elevation view of the instant mooring system at an offshore site.

A piled base of this type is found by the industry to be suitable expedient for holding a surface vessel. It is appreciated, however, that a weighted, or gravity type base, which relies on its mass or bulk for holding power, could be utilized as well. For the purpose of the instant description, the piled type base or foundation will be hereinafter referred to.

The upper end of elongated body 11 includes a cap 15 from which tower 16 extends coaxially of body 11. Tower 16 rises a sufficient distance to be above the water's surface 17, and to remain so even though mast 10 is displaced into a non-vertical alignment.

Tower 16, although not shown in specific detail, includes a mooring ring 18 to receive a line 19 from an adjacently positioned vessel 21 which would normally be a tanker or similar cargo carrying ship. Tower 16 is further provided with means to accommodate one or more hoses or conduits 22 which float on the water or ice to carry cargo. Means can be further provided to either float or support the respective conduits above the ice.

The mooring facility further includes a plurality of embedded anchors 23 such as piles or the like. The anchor piles are spaced outwardly from foundation 13 and are arranged around mast 10 preferably being radially equidistant apart. They will thereby best function to oppose the vertical forces which act against mast 10.

A plurality of restraining cables 24 are connected to cap 15, each of which extends to an anchor 23.

To facilitate operation of mast 10, the latter can be provided with internal buoyancy means such as rigid or inflatable tanks disposed in a manner to maintain it in a generally upright position when relieved of any displacing forces by a moored vessel 21.

Referring again to FIGS. 1 and 2, the vessel mooring system more fully described, includes as noted foundation or base 13 which is piled into floor 26 of the offshore body of water. Among other components, foundation 13 includes pivotal connector 12 segment which corresponds with, and engages a pivotal connector section at the lower end of mast 10.

Base 13 as is normally used in this type of an installation can be formed of concrete or steel. The primary function of this member is to define a foundation at the ocean floor 26 upon which the mooring mast 11 will be retained. The dimensions and weight of the foundation are contingent on the consistency of the ocean floor and on the depth of the water.

Base 13 is maintained fixed to floor 26 by a series of piles 14 or similar fastening members which extend through the base. The number of piles required and their driven depth will be a function of the composition of the substrate into which the piles are embedded.

Base 13 is further provided with means to receive a plurality of pipelines 27 which extend from a shore based installation. These pipelines or conduits normally rest on or are buried into the ocean floor as they are led to and connected to base 13. Each pipeline 27 is provided with a flexible connector 28 which extends from the terminus of the pipeline, up into a riser 29 which extends longitudinally of elongated body 11. This general type of conduit connector is well known in the industry and can assume a variety of configurations in the instant arrangement.

Flexible connectors 28 are furnished to permit elongated body 11 to oscillate in a manner to be hereinafter described in response to forces applied to mast 10. These forces can be induced as noted by a moored vessel or by moving ice.

A primary feature of base 13, is the pivotal connector 12, preferably disposed centrally thereof. Said connection corresponds with and engages a similar pivotal member which depends from elongated body 11 whereby the latter can exercise a limited degree of oscillatory or pivotal movement.

Mooring mast 10 is structured primarily of cylindrical, elongated body 11 which approximates in length the depth of the water in which the apparatus is to operate. Body 11 can be formed of a plurality of longitudinal stringers which are in turn reinforced to give the body necessary structural integrity. In the alternative, the entire body 11 can be formed of a sufficiently thick walled cylindrical tubular that the latter itself will function to provide the desired support for achieving a mooring function.

To accommodate concurrent flows of different fluids to and from a moored tanker 21, a plurality of conduits 29 extend longitudinally of elongated body 11. Said conduits are spaced appropriately to be fixedly positioned at the body's wall, or otherwise stabilized to prevent unnecessary movement as body 11 is strained.

To facilitate maintenance of the mooring mast 10 in a substantially vertical disposition, body 11 is provided as noted with a plurality of buoyancy tanks. The latter are disposed to afford maximum buoyancy, and yet to regulate upward lift on the pivotal joint 12 which would otherwise be stressed by excessive buoyancy in the mast.

The upper end of elongated body 11 is provided with means to guide the various fluid conduits 29 into and through tension cap 15.

Tension cap 15 as noted is comprised primarily of elongated column 16 which is of a relatively small diameter in contrast to the diameter of elongated body 11. Said column 16 is preferably formed of a cylindrical steel which is formulated to accommodate colder ambient air temperatures. The diameter of tower 16 is minimized for two reasons.

Firstly, tower 16 will serve to guide the various fluid carrying conduits 29 toward the column upper end where they terminate at a mooring manifold or ring 18. The latter is provided with a series of connections which permit individual hoses to be communicated with vessel 21 and particularly with cargo tanks on the vessel so that a number of fluid flows can be moved concurrently to or from moored vessel 21.

Tension cap 15 is further provided with a ring 32 having a constricted neck 33 at the upper end which connects to the column 16 at a peripheral welded joint 31. The lower end of ring 32 includes a plurality of radial braces 34 which extend inwardly to also engage the lower end of the column 16. The latter is thereby provided with spaced apart supports which furnish a degree of rigidity in spite of being subjected at its upper end to bending stress induced by mooring line 19.

Tension cap 15 is firmly fixed to the upper end of body 11 through ring 32 which is bolted or welded to the body upper edge.

The outer periphery of ring 32 is provided with a series of cable connectors 36 which depends therefrom and includes a connector sleeve 37. The latter is operably mounted by a hinge pin to an outward projecting connector 36. The peripherally arranged cable connectors 36 can thereby be subjected to tension but will be free to adjust their position as mast 10 is displaced from a vertical disposition.

Anchors 23 are positioned a preferred distance from base 13 to afford the desired support to the mast 10 when the latter is subjected to displacing forces. The respective anchors 23 as shown, in one embodiment can take the form of an anchor pile, which is embedded into ocean floor 26, a sufficient distance to resist being dislodged.

Figure 3:
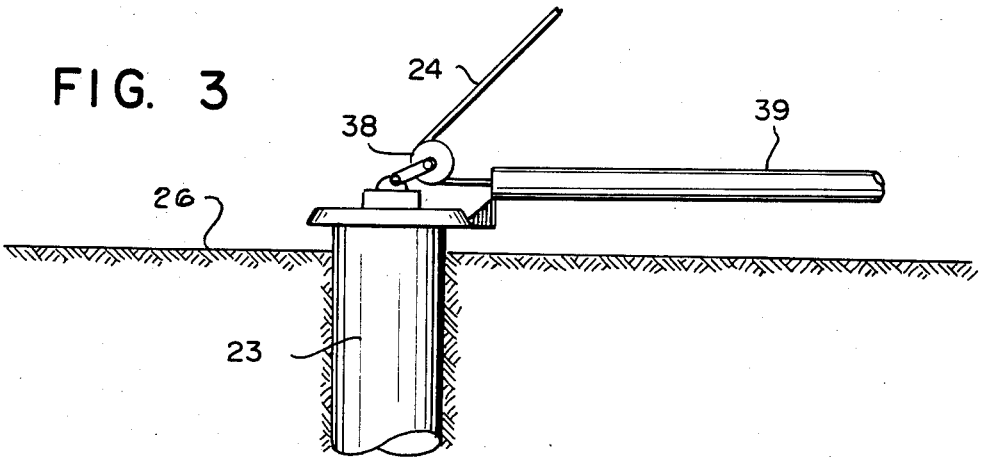
FIG. 3 is a segmentary view on an enlarged scale of the anchor shown in FIG. 1.

As shown in FIG. 3, each anchor pile 23 is provided with a mounting plate 35 at the upper end thereof which holds means to engage a cable 24. The latter is connected to the anchor in a manner to allow pulling stresses to be transmitted into the anchor.

Anchors 23, at least four in number, are preferably positioned in a circular pattern about foundation 13. They are radially arranged to furnish the means for countering the displaced forces by way of one or more cables 24 to tension cap 15.

In one embodiment of the invention, means is provided in the disclosed arrangement for adjusting mast 10 by manipulation of tension in selective cables. To facilitate this controlled oscillatory movement, cables 24 are looped through a pulley 38 at each anchor 23 and terminated at a cable adjusting means or cable take-up at the base 13.

Figure 2:
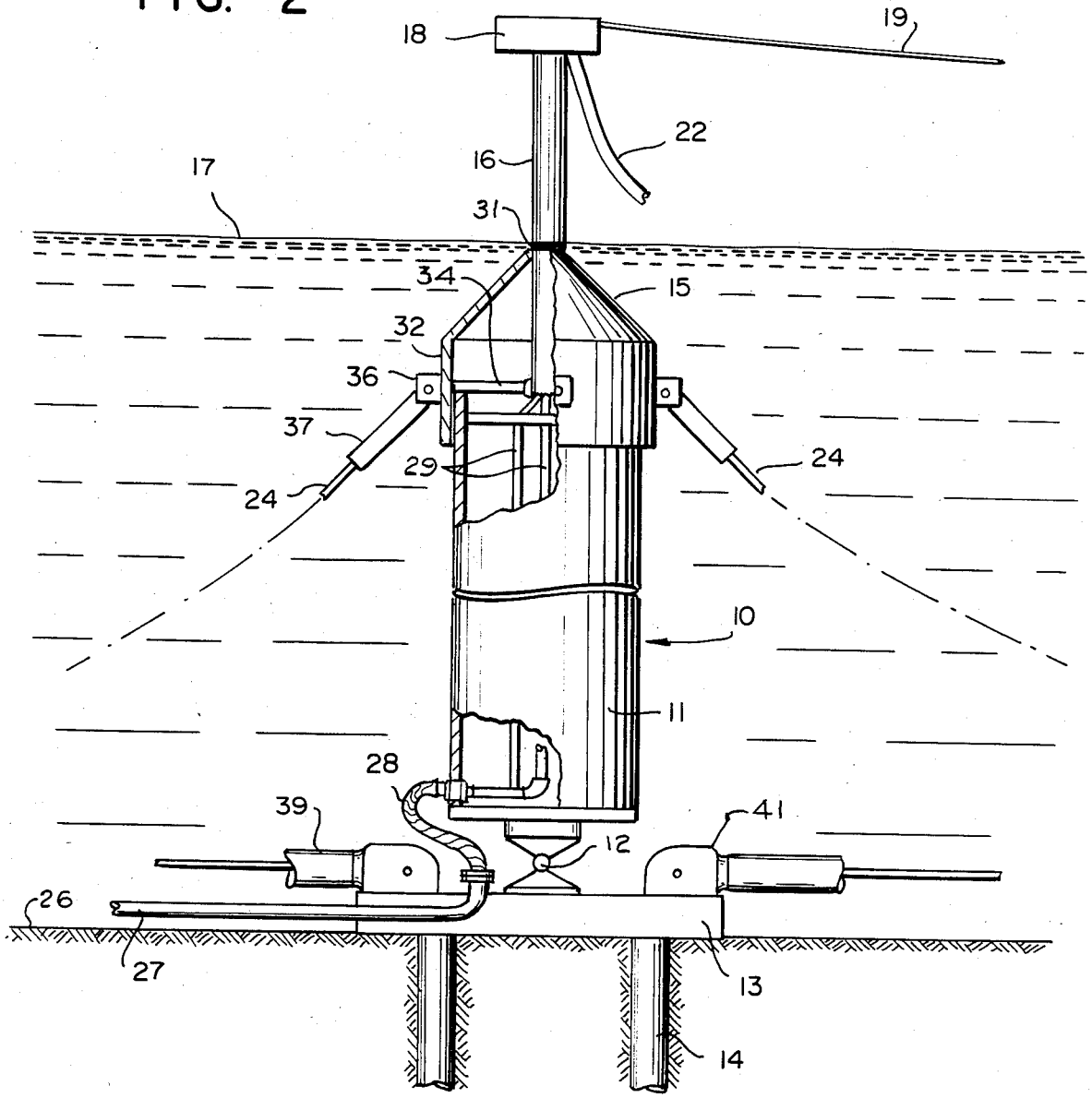
FIG. 2 is an enlarged section of the apparatus shown in FIG. 1, with parts broken away.

As shown in FIGS. 2 and 3, each cable connector sleeve 37 engages a cable end. The cable is thereafter threaded through pulley 38 at anchor 23 and led to a cable take-up mechanism 41 on base 13. The latter mechanism can assume the form of a wind-up drum or similar means which is capable of varying the length and the tension in cable 24 by winding or unwinding as the latter is used to support and displace mooring mast 10 as needed.

The respective cable take-ups 41 are remotely actuated from a control center above the water, preferably from a shore position to best regulate the disposition of mooring mast 10. Thus, the latter can be appropriately adjusted for a liquid loading operation, or for the purpose of breaking up sheet ice adjacent thereto.

Figure 4:
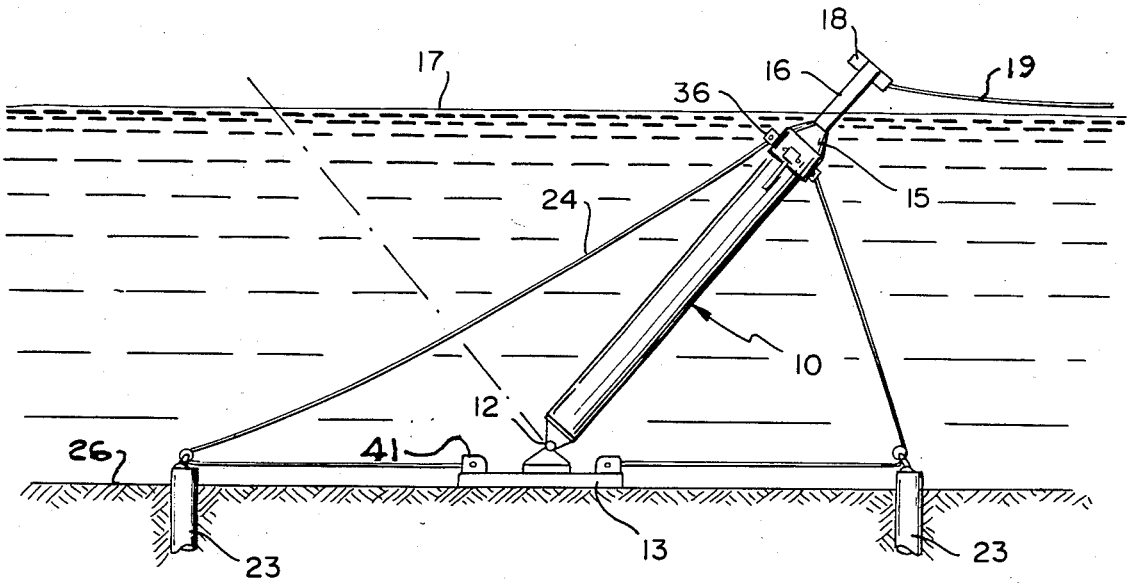
FIG. 4 is similar to FIG. 1 showing the mooring mast displaced.

Operationally, and as shown in FIG. 4, the mooring structure is formed in a manner that when it is subjected to the pull of a moored vessel 21, the displacing force exerted by cable 19 will be directed through tension cap 15 and into the restraining cables 24 which act in the opposite direction. This displacing force will thereafter be transferred through at least some of cables 24 into anchors 23 and the ocean floor, as well as into the base 13.

In summary, regardless of the tension or the displacing force applied to the upper portion of tower 16, the major thrust of the applied force wil be directed by way of two or more of the restraining cable 24 into the substrate. The force along the cables will thus have but a relatively minor compressive or tensional effect on the pivotal connector 12.

To maintain the lower portion of restraining cables 24 off the ocean floor 26, an elongated tubular member 39 can optionally be positioned which extend between each anchor 23 and base 13. Said tubular can take the form of a pipe or like member which is attached at opposed ends to the respective anchor 23 and to base 13 and in alignment with cable take-up 26. This tubular member, if of adequate size, can rest on oceanfloor 26, ro be supported thereabove.

Referring to FIG. 4, when the site of the disclosed mooring is in an Arctic or similar setting, such as Alaskan waters which are subject to formation of sheet ice, the presently disclosed system can be operated to keep the area about tower 16 free of the ice build-up. Thus, by applying tension to selected restraining cables 24, and concurrently relaxing tension on oppositely positioned cables, mast 10 can be caused to be slowly and controllably oscillated. Over a period of time, such controlled movement will break up solid ice sheets and avoid built-up formations thereof at the water's surface.

It is understood that although modifications and variations of the invention may be made without departing from the spirit and scope thereof, only such limitations should be imposed as are indicated in the appended claims.

We claim:

1. In an offshore installation for mooring a marine vessel during an on or offloading operation in a body of water that is subjected to floating ice, a foundation base (13) supported on the floor of said body of water and having a pivotal connector (12) depending therefrom, a mast (10) having a lower end thereof operably engaged to said pivotal connector (12) and being supported in a generally vertical disposition, a tension cap (15) at said mast (10) upper end and including; a ring (32) fixed to the mast, and a column (16) extending upwardly therefrom to a point beyond the water's surface, a plurality of anchors (23) spaced outwardly from said foundation (13), being embedded in the floor of said offshore body of water, and including pulley means (38) thereon, cable take-up means (41) positioned on said foundation base (13), and a plurality of cable means (24) connected at one end thereof to said tension cap (15), being registered in said pulley means (38), and being operably engaged to said cable take-up means (41), whereby said cable means (24) are selectively adjustable to apply a directional force to said tension cap (15) in response to displacement of the mast (10) from a vertical disposition when the mast upper end is subjected to a lateral displacing force.

2. In the apparatus as defined in claim 1, wherein said cable take-up means includes a plurality of take-up units positioned on said foundation base.

3. In the apparatus as defined in claim 1, including a protective conductor extending from said anchor (23) to said foundation (13) and enclosing at last a portion of the cable means (24).

4. In the apparatus as defined in claim 2, wherein said take-up units (41) are disposed about said pivotal connector (12), each take-up unit engaging the end of one of said plurality of cable means (24).

* * * * *